US005305804A

United States Patent [19]

Peder

[11] Patent Number: 5,305,804

[45] Date of Patent: Apr. 26, 1994

[54] APPARATUS FOR CONNECTING TWO MUTUALLY CROSSING CABLE PORTIONS

[75] Inventor: Fabio Peder, Laives, Italy

[73] Assignee: Eurock S.p.A., Milan, Italy

[21] Appl. No.: 16,955

[22] Filed: Feb. 12, 1993

Related U.S. Application Data

[63] Continuation-in-part of Ser. No. 606,839, Oct. 31, 1990, Pat. No. 5,190,080.

[51] Int. Cl.[5] ..... B21F 27/08

[52] U.S. Cl. ..... 140/115; 140/57

[58] Field of Search ..... 140/3 R, 4, 10, 11, 140/57, 92.1, 93 R, 115; 245/2, 3, 4

[56] References Cited

U.S. PATENT DOCUMENTS

| | | |
|---|---|---|
| 496,087 | 4/1893 | Lamb . |
| 2,111,775 | 11/1936 | Hanson . |
| 2,763,296 | 9/1956 | Recoq . |
| 3,388,725 | 6/1968 | Richardson . |
| 4,030,527 | 6/1977 | Roch . |
| 4,121,629 | 10/1978 | Sackl et al. . |
| 4,641,991 | 2/1987 | Yaoita . |

FOREIGN PATENT DOCUMENTS

| | | |
|---|---|---|
| B363765 | 8/1981 | Austria . |
| 0428848 | 5/1991 | European Pat. Off. . |
| 2629492 | 10/1989 | France . |
| 370902 | 9/1963 | Switzerland . |
| 418045 | 2/1967 | Switzerland . |
| 11098 | 7/1916 | United Kingdom . |

*Primary Examiner*—Lowell A. Larson
*Attorney, Agent, or Firm*—Keck, Mahin & Cate

[57] ABSTRACT

Apparatus for connecting two mutually crossing cable portions (2, 3) at respective intersections (17) of a netting formed from one or more cables, with two wires to be wound around the cable portions at the intersections, comprises two hollow wheels (4, 5) which are driven about a common axis (DA) in mutually opposite directions, with wire receiving means (20, 21) for the wires (12, 13), which are mounted in cavities in the drive wheels (4, 5) displaceably in mutually opposite axial directions and are non-rotatably connected to the drive wheels (4, 5). The two hollow wheels (4, 5) are rotatably mounted on a frame (1, 6, 7) and are driven by a common drive means (8-10, 14).

10 Claims, 5 Drawing Sheets

APPARATUS FOR CONNECTING TWO MUTUALLY CROSSING CABLE PORTIONS

RELATED APPLICATION

This application is a continuation-in-part of Ser. No. 07/606,839, filed Oct. 31, 1990, now U.S. Pat. No. 5,190,080 granted Mar. 2, 1993, the entire disclosure of which is incorporated herein, by reference.

FIELD OF THE INVENTION

The invention relates to an apparatus for connecting two mutually crossing cable portions at respective cable intersections of a netting formed from one or more cables, with two wires which are to be wound around the cable portions at the intersection.

BACKGROUND OF THE INVENTION

An apparatus of the kind is known from EP 0 428 848 A1, which corresponds to the patent application identified above. In the known apparatus, the two wires are wound around the cable portions at the intersections by means of two winding elements which have wire entrainment means. The two winding elements rotate in opposite directions of rotation about a common axis of rotation which is determined by the cable portions to be wound around.

The problem of the present invention is to provide an apparatus of the kind set forth above, in which a common drive is provided for the two winding elements in a simple manner.

In accordance with the present invention that problem is solved by

- two wheels of a hollow configuration which are driven about a common axis in mutually opposite directions;
- wire receiving means for the wires which are to be wound around the cable portions at the intersections, the wire receiving means being mounted in the cavities in the drive wheels displaceably in mutually opposite axial directions and being non-rotatably connected to the hollow wheels;
- a frame on which the two hollow wheels are rotatably mounted; and
- a common drive device for the two hollow wheels.

The two hollow wheels guarantee a support for winding elements which are for example of a cylindrical configuration and which contain the wire receiving means which in known manner can be in the form of bores extending in the winding elements parallel to the common axis of rotation. The support can be provided on a common frame which has two mounting plates, the hollow wheels being mounted rotatably on the two mounting plates.

The drive for the hollow wheels and thus the wire receiving means carried by the hollow wheels, about the common axis of rotation, can be in the form of a manual drive, for example a hand crank. It is also possible however to use a motor for the common drive, for example a pneumatic motor, or a hydraulic motor, or an electric motor. Possibly the hand crank or the motor drive can be optionally flange-mounted to a common drive shaft by way of which the drive moment is transmitted to the hollow wheels.

Between the common drive shaft and the hollow wheels, the apparatus may have two transmission assemblies using pulling means, or transmission assemblies using gears, or transmission assemblies with a similar action which drive the hollow wheels in opposite directions of rotation. Preferably, a transmission assembly using pulling means is used for each of the hollow wheels.

BRIEF DESCRIPTION OF THE DRAWINGS

The invention will now be described in greater detail by means of an embodiment illustrated by way of example with reference to the accompanying drawings in which.

DETAILED DESCRIPTION OF THE PREFERRED EMBODIMENTS

Figure 1:
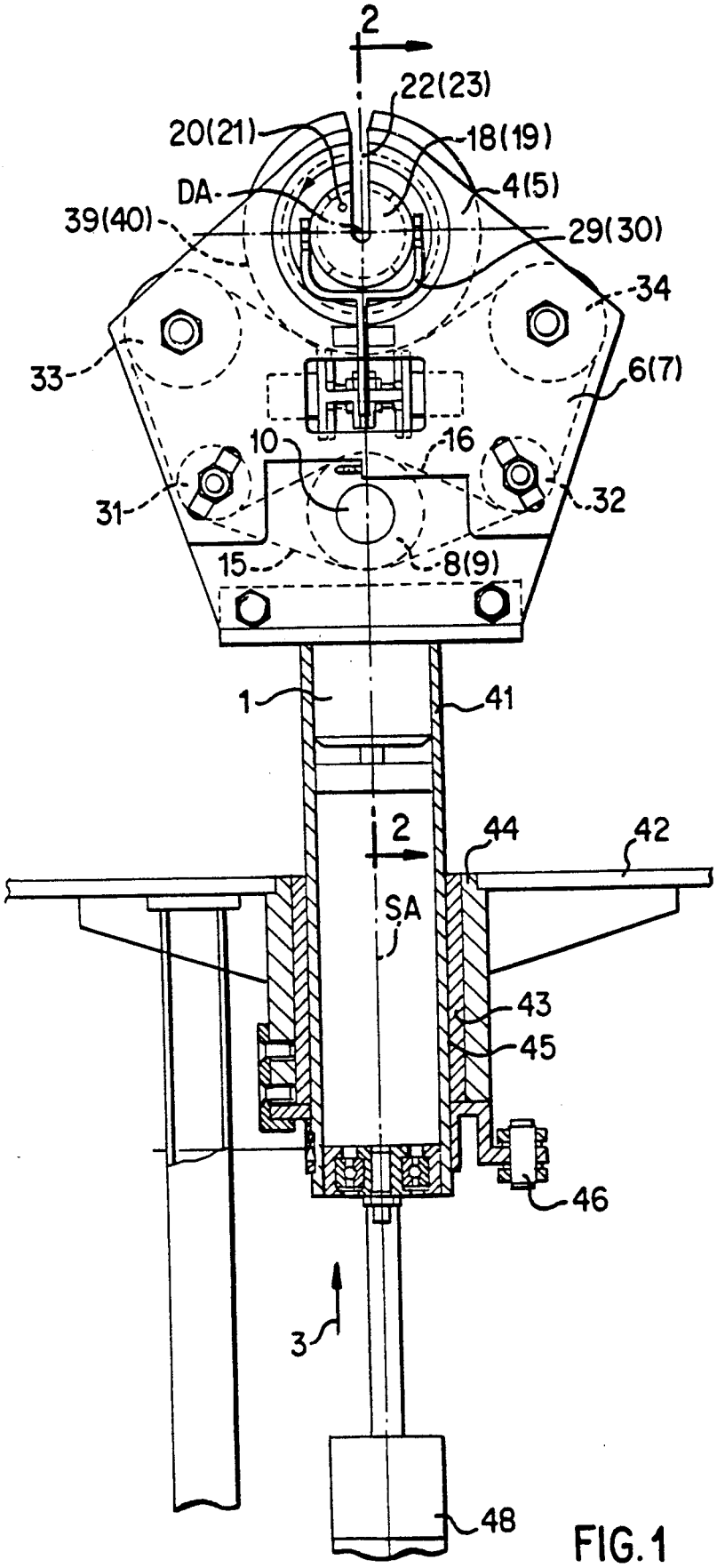
FIG. 1 is a partly sectional side view of an embodiment of the invention.
Figure 2:
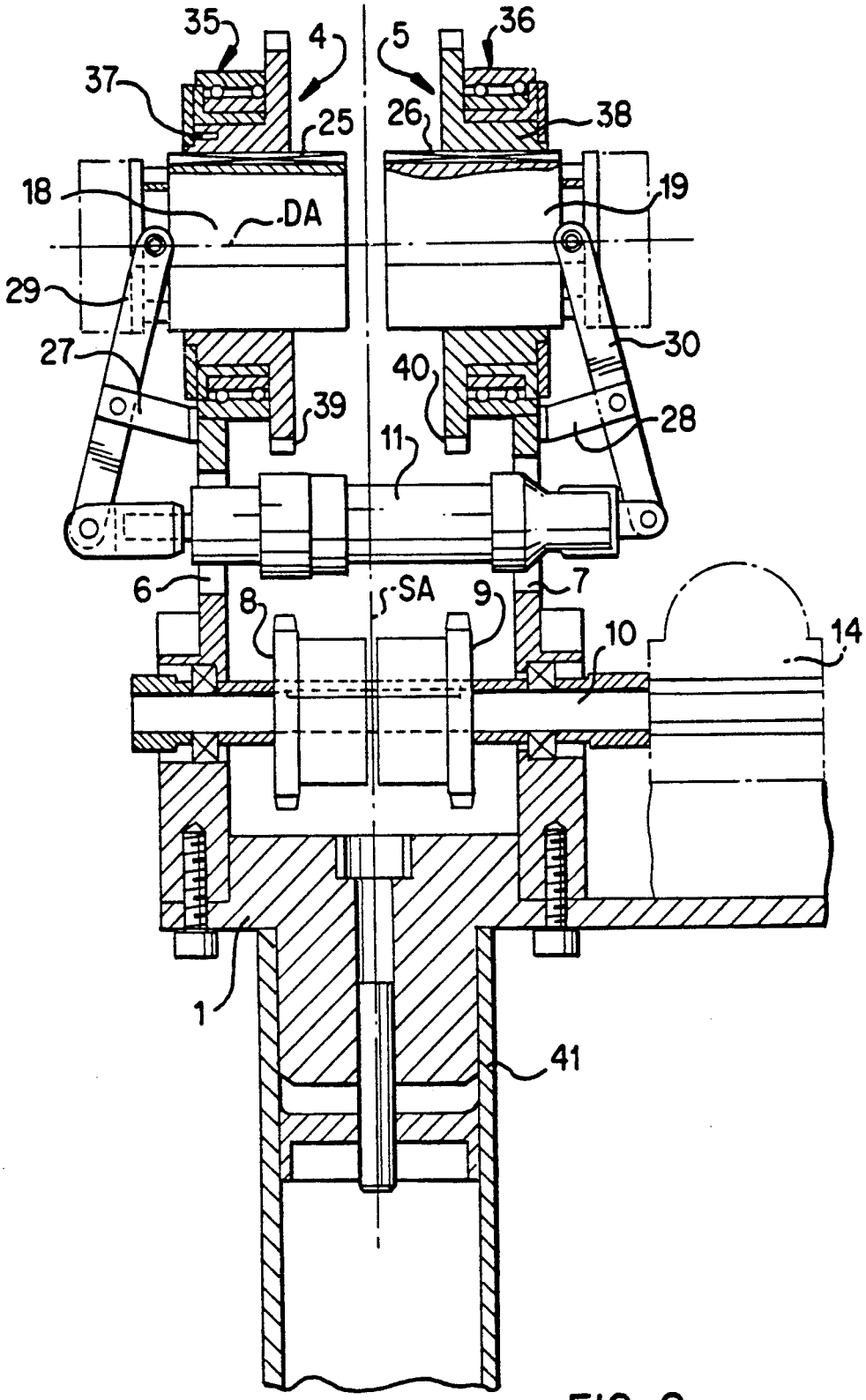
FIG. 2 is a view of the embodiment shown in FIG. 1 in section taken along section line 2—2 in FIG. 1.

As shown in FIGS. 1 and 2, cylindrical winding elements 18 and 19 which are of a configuration as is known from EP 0 428 848 A1 are disposed in hollow wheels 4 and 5. The arrangement is such that the two winding elements 18 and 19 and the two hollow wheels 4 and 5 are rotatable about a common axis of rotation as indicated at DA. For that purpose the hollow wheels 4 and 5 are rotatably mounted on mounting frame plates 6 and 7. For that purpose, hollow-cylindrical mounting assemblies 35 and 36 are provided on the mounting frame plates 6 and 7. The hollow-cylindrical mounting assemblies 35 and 36 each include respective hub portions 37 and 38 for rotatably supporting the hollow wheels 4 and 5. The hollow wheels 4 and 5 also each have a respective ring gear 39 and 40 engaged by drive chains 15 and 16 for driving the winding elements 18 and 19 in opposite relationship, as will be described in greater detail hereinafter.

The winding elements 18 and 19 are mounted non-rotatably in the hollow wheels 4 and 5, for example by means of splines 25 and 26. The rotary movement of the hollow wheels 4 and 5 is therefore transmitted to the winding elements 18 and 19.

The winding elements 18 and 19 are mounted displaceably in the axial direction in the respective hollow wheels 4 and 5. In that way it is possible for the two winding elements 18 and 19 to be displaced axially in mutually opposite directions during the operation of winding a wire around first and second cable portions as indicated at 2 and 3 in FIGS. 4 and 5, which are adjacent to a cable intersection as indicated at 17 in FIG. 4. The winding operation will be described in greater detail hereinafter with reference to FIGS. 4 and 5.

Figure 4:
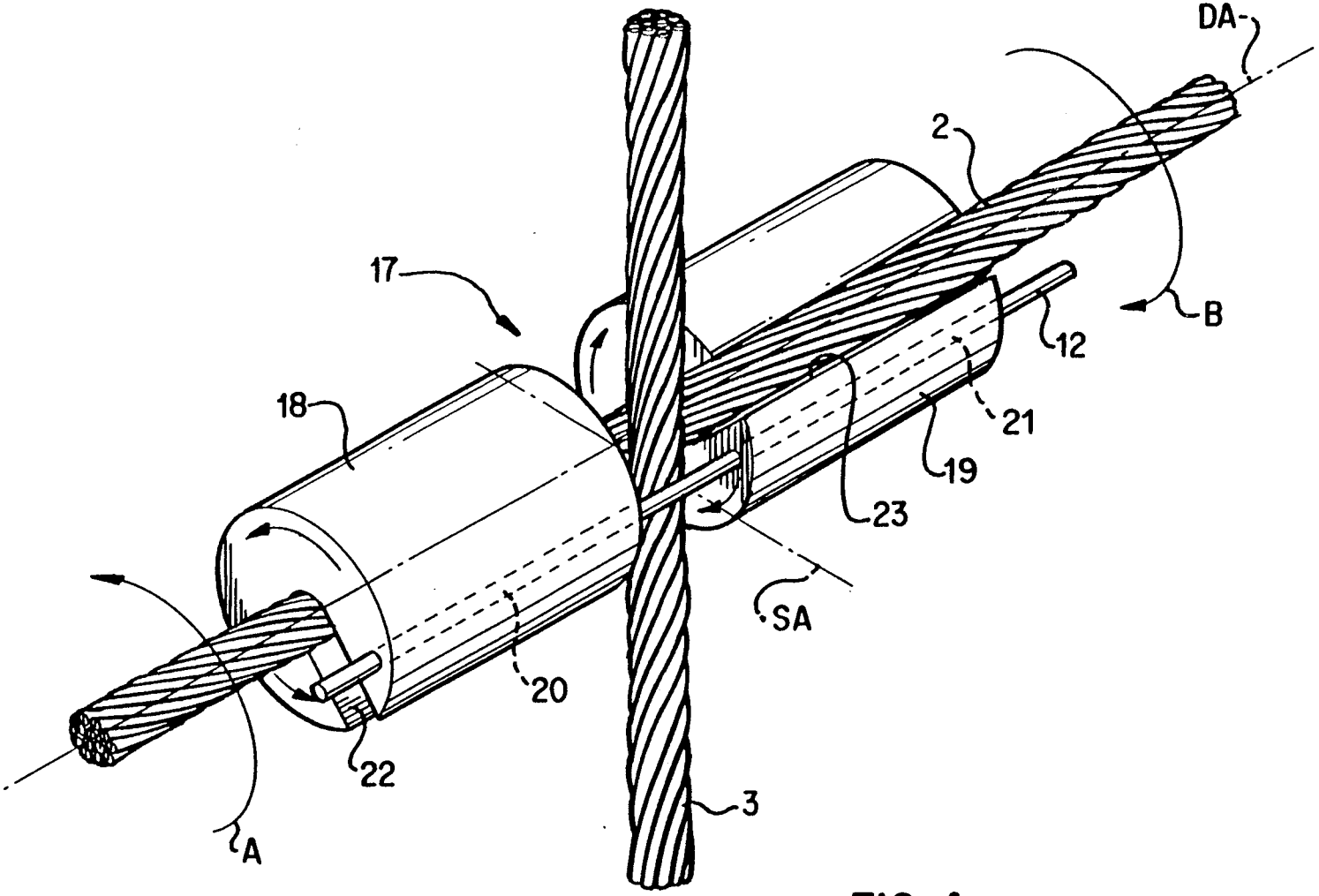
FIG. 4 shows cylindrical winding elements in a first winding position.
Figure 5:
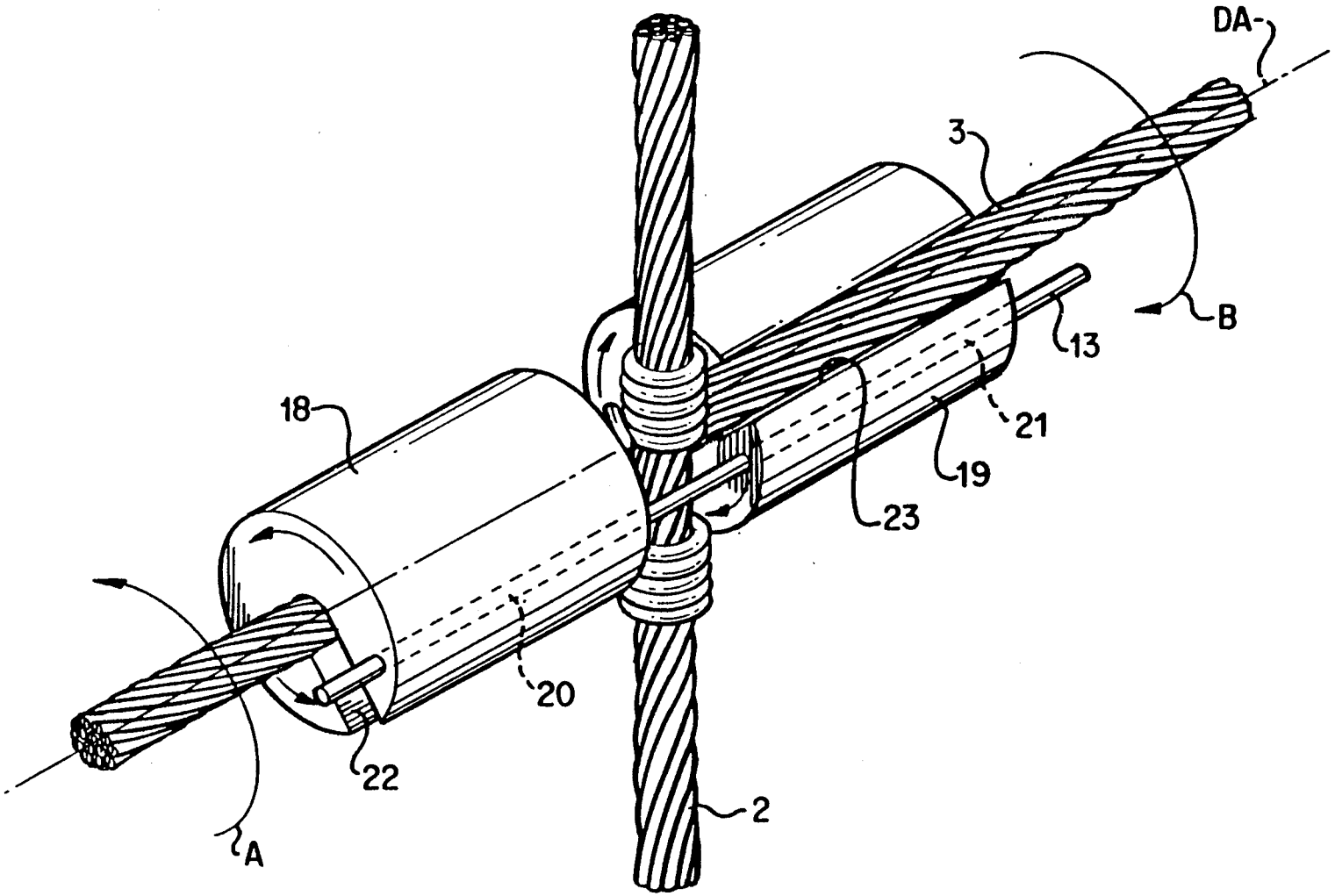
FIG. 5 shows the cylindrical winding elements in a second winding position.

Provided in the winding elements 18 and 19 and in the two hollow wheels 4 and 5 are openings 22 and 23 respectively which can be aligned with each other in such a way that the two cable portions 2 and 3 which are to be joined together at a respective intersection 17 can be laid around the common axis of rotation DA, as shown in FIGS. 4 and 5.

The winding elements 18 and 19 also have wire receiving means 20 and 21 respectively in the form of through bores which extend parallel to the common axis of rotation DA. As can be seen from FIG. 4, the two bores forming the wire receiving means 20 and 21 are aligned with each other for a respective wire 12 or 13 to be pushed therethrough.

For controlled movement of the winding elements 18, 19 in the axial direction towards and away from each other, the apparatus has an actuating arrangement illustrated in the form of a piston-cylinder arrangement 11 shown in FIG. 2, which produces the drive for the axial movements of the winding elements 18 and 19. The drive force can be transmitted by way of forks 29 and 30 which are supported on the mounting plates 6 and 7 at fork support brackets 27 and 28 respectively. Axial displacement of the winding elements 18 and 19 in the hollow wheels 4 and 5 can also be effected automatically by virtue of the turns of wire on the cable portions 2 and 3 becoming extended in the axial direction. By virtue of the drive effect produced by the piston-cylinder arrangements 11, the winding elements 18 and 19 can be moved back into their starting position for a fresh winding operation.

A common drive is provided for the illustrated embodiment. The torque produced by the common drive is transmitted by way of a common drive shaft 10. Non-rotatably carried on the common drive shaft 10 are drive wheels 8 and 9 which can be in the form of chain wheels or chain gears. The drive wheels 8 and 9, in the form of chain wheels, engage with the drive chains 15 and 16 which in turn are engaged with the ring gears 39 and 40 on the hollow wheels 4 and 5. As can be seen in particular from FIG. 1, the drive chains 15 and 16 engage the portion of the periphery of each of the ring gears 39 and 40, which is disposed at the bottom thereof when viewing FIG. 1. Those regions of the ring gears 39 and 40 on the hollow wheels 4 and 5 are most closely adjacent to the common drive shaft 10. To provide for a rotary drive in opposite directions, one drive chain 15 is in engagement with the bottom part of the tooth configuration of one of the two drive gears 8 and 9, for example the bottom part of the periphery of the tooth configuration of the drive gear 8. That part of the tooth configuration of the drive gear 8 is at the side of the drive gear 8 which, relative to the drive shaft 10, is remote from the respectively associated hollow wheel to be driven, for example the wheel 4.

The other drive chain 16 engages with the other drive wheel, for example the drive wheel 9, at the portion of the tooth configuration thereof which, with respect to the drive shaft 10, is in opposite relationship to the engagement between the chain 15 and its drive gear 8. The part of the drive gear 9 which is engaged by the drive chain 16 is towards the associated hollow wheel 5 which is to be driven thereby. The drive wheels 8 and 9 which are both carried on the drive shaft 10 are driven in the same direction. As however the drive chains 15 and 16 engage the drive wheels 8 and 9 at opposite sides thereof, as can be clearly seen from FIG. 1, the drive chains 15 and 16 are driven in mutually opposite directions, and those mutually opposite directions are accordingly transmitted to the respective ones of the hollow wheels 4 and 5. Therefore the two hollow wheels 4 and 5 are driven in opposite directions of rotation about the common axis DA.

The common drive as indicated at 14 in FIG. 2 may be a manual drive or a motorised drive. The manual drive may be a crank which is fitted on to the common drive shaft 10. A suitable motorised drive is by means of a hydraulic motor or a pneumatically operated motor or an electric motor.

As can also be seen from FIG. 1, direction-changing shafts 31 to 34 are provided for guiding the drive chains 15 and 16 in the required configuration, being mounted on the two mounting plates 6 and 7. There are four such direction-direction shafts 31 to 34, for each of the two chains 15 and 16.

Figure 3:
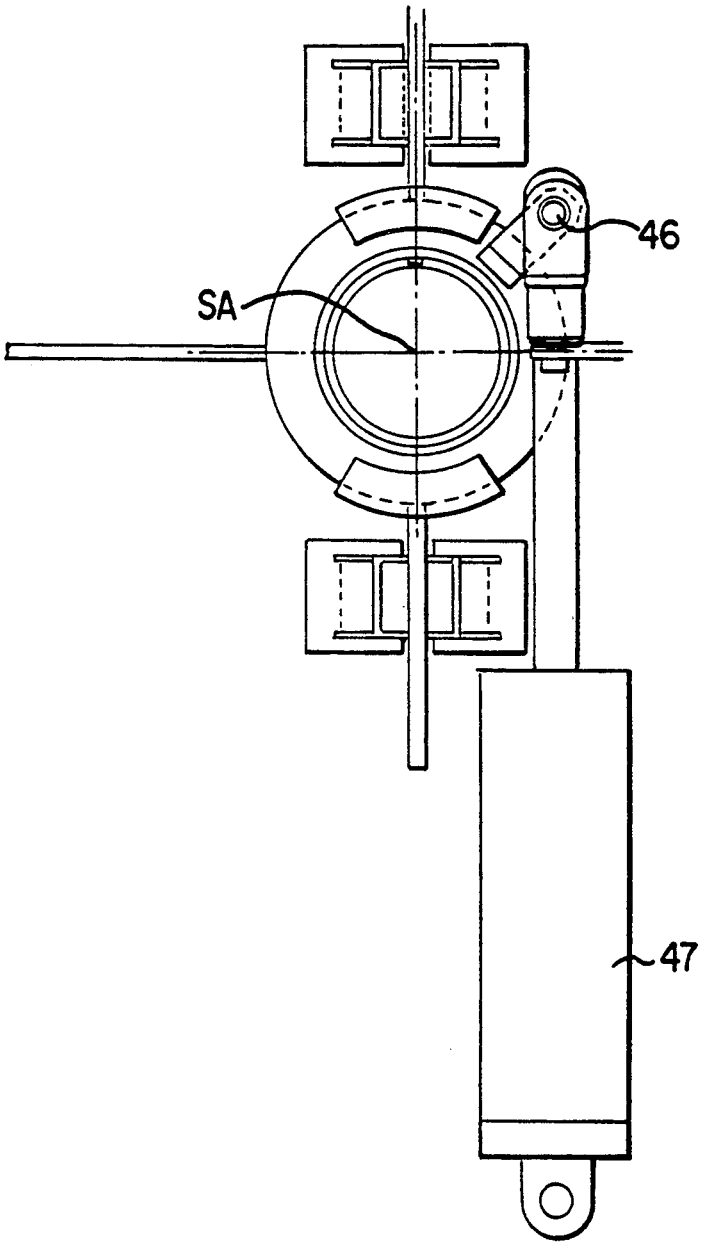
FIG. 3 is a view of part of the FIG. 1 apparatus looking in the direction indicated by the arrow 3; in FIG. 1.

The two mounting plates 6 and 7 are fixed to a main body 1. The main body 1 is in turn fixed in a holder 41 which can be in the form of a cylindrical member, as shown in the illustrated embodiment. The holder 41 can serve as a handle, in particular for mechanical actuation of the winding assembly shown in the drawings. The holder 41 can be used to move the winding assembly manually from the position shown in FIG. 4 into the position shown in FIG. 5. In other words, in that way the winding assembly can be turned by hand about a vertical axis SA (see FIG. 2) which extends perpendicularly to the common axis of rotation DA. However, as shown in FIGS. 1 and 3, that turning movement can also be produced mechanically, by means of a crank device.

For that purpose, as shown in FIG. 1, the holder 41 is mounted rotatably in a frame generally indicated at 42. That frame can be a component of the carriage which in EP 0 428 848 A1 is guided in the XY-co-ordinate guide means. In that arrangement, the holder 41 can be interchangeably fitted in the crank device which is shown in FIGS. 1 and 3 and which will be described in greater detail hereinafter.

Provided on the frame 42 is a cylindrical guide 43 for the holder 41. The guide 43 is in turn mounted rotatably in a mounting arrangement 44 on the machine frame as indicated at 43. The holder 41 is non-rotatably connected to the guide 43 so that it can be rotated together with the guide 43. The non-rotatable connection between the guide 43 and the holder 41 can be formed by splines as indicated at 45.

A crank 46 is provided for rotary drive for the guide 43 in the mounting arrangement fixed to the frame 42. The crank 46 is engaged by a piston-cylinder arrangement 47 in FIG. 3, by means of which the crank 46 and therewith the holder 41 can be pivoted through 90°. That pivotal movement through 90° is about the vertical axis SA when the arrangement of the winding elements 18 and 19 is moved into the respective positions shown in FIGS. 4 and 5. As already mentioned however that can also be done by hand if the holder 41 is in the form of a handle.

In addition, the holder 41 can be displaced axially in the guide 43 to permit axial sliding movement of the holder 41 and therewith the winding arrangement secured thereto. That axial displacement can be effected by a drive device, for example in the form of a further piston-cylinder arrangement 48. That axial displacement serves to provide corresponding relative displacement of the winding elements 18 and 19, together with the associated hollow wheels 4 and 5, with respect to the cable portions 2 and 3 which are to be joined together at the intersections 17. In that way the winding elements 18 and 19 and the associated hollow wheels 4 and 5 can be moved into such a position that their common axis of rotation DA can be moved into alignment with the respective cable portions 2 and 3 to be wound around (see FIGS. 4 and 5) and removed again from that position.

The winding operation is effected in the same manner as described in EP 0 428 848 A1 and results in the cable connections known therein at the cable intersections.

What is claimed is:

1. Apparatus for connecting two mutually crossing cable portions (2, 3) at respective cable intersections (17) of a netting formed by one or more cables, said netting having two wires (12, 13) wound around the cable portions at the intersections, said apparatus comprising:

two wheels (4, 5) of a hollow configuration, which are driven about a common axis (DA) in mutually opposite directions;

wire receiving means (20, 21) for the wires (12, 13), which are mounted in cavities in the hollow wheels (4, 5) displaceably in mutually opposite axial directions and which are non-rotatably connected to the hollow wheels (4, 5);

a frame (1, 6, 7) on which the hollow wheels (4, 5) are rotatably mounted; and a common drive means (8–10, 14) for the hollow wheels (4, 5).

2. Apparatus according to claim 1 further comprising recesses (22, 23) in the hollow wheels (4, 5) and the wire receiving means (20, 21) extending radially as far as the common axis (DA) and over the entire axial length of the respective assemblies comprising the wire receiving means (20, 21) and the hollow wheels (4, 5).

3. Apparatus according to claim 2 wherein the common drive means (8–10, 14) comprises a common drive shaft (10) and two drive wheels (8, 9) forming with the two hollow wheels (4, 5) a transmission assembly (4, 5, 8, 9, 15, 16) for driving the two hollow wheels from the two drive wheels.

4. Apparatus according to claim 1 wherein the common drive means (8–10, 14) comprises a common drive shaft (10) and two drive wheels (8, 9) forming with the two hollow wheels (4, 5) a transmission assembly (4, 5, 8, 9, 15, 16) for driving the two hollow wheels from the two drive wheels.

5. Apparatus according to claim 4 wherein the transmission assembly (4, 5, 8, 9, 15, 16) comprises two pulling means (15, 16) each associated with respective ones of the two drive wheels (8, 9) and the two hollow wheels (4, 5), wherein the two pulling means (15, 16) pass around the respective drive wheels (8, 9) with which they are drivingly engaged at opposite sides in relation to the common drive shaft (10).

6. Apparatus according to claim 5 comprising direction-changing guide shafts (31–34) for the pulling means (15, 16) provided between the drive wheels (8, 9) and the hollow wheels (4, 5).

7. Apparatus according to claim 6 wherein, according to their positioning on the frame (6, 7), said direction-changing guide shafts (31–34) determine the angle through which the pulling means (15, 16) extend around the respective drive wheels (8, 9).

8. Apparatus according to claim 4 wherein the common drive shaft (10) is driven manually.

9. Apparatus according to claim 4 wherein the common drive shaft (10) is driven by a motor.

10. Apparatus according to claim 4 wherein said transmission assembly (4, 5, 8, 9, 15, 16) comprises a chain transmission.

* * * * *